US010438742B2

(12) United States Patent
Kobuchi et al.

(10) Patent No.: US 10,438,742 B2
(45) Date of Patent: Oct. 8, 2019

(54) MANUFACTURING METHOD OF RARE-EARTH MAGNET

(71) Applicant: TOYOTA JIDOSHA KABUSHIKI KAISHA, Toyota-shi, Aichi-ken (JP)

(72) Inventors: Dai Kobuchi, Nagoya (JP); Eisuke Hoshina, Toyota (JP); Daisuke Ichigosaki, Toyota (JP); Osamu Yamashita, Toyota (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 648 days.

(21) Appl. No.: 14/837,734

(22) Filed: Aug. 27, 2015

(65) Prior Publication Data

US 2016/0064145 A1 Mar. 3, 2016

(30) Foreign Application Priority Data

Aug. 28, 2014 (JP) ..... 2014-173399

(51) Int. Cl.

| | |
|---|---|
| ***H01F 41/02*** | (2006.01) |
| ***B22F 3/12*** | (2006.01) |
| ***B22F 3/24*** | (2006.01) |
| ***H01F 1/053*** | (2006.01) |
| ***B22F 3/14*** | (2006.01) |
| ***B22F 5/00*** | (2006.01) |
| ***H01F 1/057*** | (2006.01) |

(52) U.S. Cl.

CPC ..... *H01F 41/0266* (2013.01); *B22F 3/14* (2013.01); *B22F 5/00* (2013.01); *H01F 1/0576* (2013.01); *C22C 2202/02* (2013.01); *H01F 1/0577* (2013.01)

(58) Field of Classification Search

None

See application file for complete search history.

(56) References Cited

U.S. PATENT DOCUMENTS

| | | | | |
|---|---|---|---|---|
| 4,859,410 | A * | 8/1989 | Brewer | H01F 1/0576 252/62.55 |
| 2013/0078369 | A1* | 3/2013 | Shoji | C22C 38/005 427/127 |
| 2015/0086710 | A1* | 3/2015 | Takagi | B05D 5/00 427/132 |

FOREIGN PATENT DOCUMENTS

| | | | |
|---|---|---|---|
| JP | 02-138706 | A | 5/1990 |
| JP | 3290906 | A | 12/1991 |
| JP | 59506 | A | 1/1993 |
| JP | 11261119 | A | 9/1999 |

OTHER PUBLICATIONS

Machine translation of JP 3-290906A, Dec. 1991.*

* cited by examiner

*Primary Examiner* — Xiaowei Su

(74) *Attorney, Agent, or Firm* — Sughrue Mion, PLLC

(57) ABSTRACT

A manufacturing method of a rare-earth magnet includes: manufacturing a sintered body having by performing pressing on a magnetic powder for a rare-earth magnet; and manufacturing a rare-earth magnet by putting the sintered body in a plastic working mold and by performing hot plastic working on the sintered body while pressing the sintered body to give anisotropy to the sintered body. The sintered body has a cuboid shape and includes at least one recessed side face that has a recessed portion curved inward. The plastic working mold includes a lower die, a side die forming a rectangular frame of four side faces, and an upper die slidable in the side die. The hot plastic working is hot upsetting.

8 Claims, 17 Drawing Sheets

BEFORE HOT UPSETTING

PROCESSING RATE OF 50%

RELATED ART

MANUFACTURING METHOD OF RARE-EARTH MAGNET

INCORPORATION BY REFERENCE

The disclosure of Japanese Patent Application No. 2014-173399 filed on Aug. 28, 2014 including the specification, drawings and abstract is incorporated herein by reference in its entirety.

BACKGROUND OF THE INVENTION

1. Field of the Invention

The present invention relates to a manufacturing method of a rare-earth magnet for manufacturing a rare-earth magnet by performing hot plastic working on a sintered body.

2. Description of Related Art

A rare-earth magnet using a rare-earth element such as lanthanoid is also called a permanent magnet. The permanent magnet is used for driving motors of a hybrid vehicle, an electric vehicle, and the like, as well as motors constituting a hard disk and an MRI.

As an index of magnetic performance of the rare-earth magnet, residual magnetization (residual magnetic flux density) and coercive force are known. In regard to an increase in heat generation amount due to downsizing and high current density of a motor, a demand of heat resistance to a rare-earth magnet to be used is increased still more, and how magnetic characteristics of a magnet can be maintained under high-temperature use is one of important research themes in the technical field.

In the technical field, there has been known a method of manufacturing a rare-earth magnet (an oriented magnet) in such a manner that a sintered body is manufactured by performing pressing on a fine powder obtained by immediately solidifying Nd—Fe—B molten metal, for example, and hot plastic working is performed on the sintered body so as to give magnetic anisotropy thereto. Further, Japanese Patent Application Publication No. 2-138706 (JP 2-138706 A) describes an anisotropic permanent magnet configured such that hot plastic working is performed on a sintered body so as to improve anisotropy and to increase a residual magnetic flux density.

As the hot plastic working, hot upsetting has been known. In the hot upsetting, a plastic working mold constituted by a lower die, a side die, and an upper die (also referred to as a punch) slidable within the side die. Then, the sintered body put in a cavity of the plastic working mold is pressed by the upper die in a short time of around one second or less, for example, while being heated to achieve a predetermined processing rate.

Although magnetic anisotropy can be given to the sintered body by the hot upsetting, the sintered body is about to be deformed laterally due to the pressing by the upper die in the upsetting. It is known that, at the time when the sintered body is about to be deformed laterally, the sintered body receives, from the upper die and the lower die, a shearing frictional force in a direction opposite to a direction of the deformation. The shearing frictional force will be described in detail with reference to FIG. 18.

FIG. 18A illustrates an analytic model of a compact sandwiched between the upper die and the lower die before the upsetting. This analytic model is a group indicative of a compact constituted by many constituent cells to execute a finite element analysis by a computer. FIG. 18B illustrates a deforming state of the analytic model after the upsetting at a processing rate of 50%. In regard to the analytic model illustrated herein, since left and right sides of a sintered body show the same analysis result, only a right section is modelled.

When the sintered body is pressed by the upper die as illustrated in FIG. 18A, a free end surface of the sintered body that has no restriction is deformed laterally as illustrated in FIG. 18B. At the time of the lateral deformation, a top face and a bottom face of the sintered body receive shearing frictional forces opposite to a lateral deformation direction, from the upper die and the lower die, respectively. As a result, plastic deformation is promoted in a central region of the sintered body as compared with its peripheral region, so that the central region becomes a high strain region. This causes orientation disturbance in a crystal structure, which may cause a decrease in residual magnetization. Further, a yield of materials may decrease so that a manufacturing cost may increase.

SUMMARY OF THE INVENTION

The present invention provides a manufacturing method of a rare-earth magnet which manufacturing method can improve uniformity of residual magnetization.

An aspect of the present invention is a manufacturing method of a rare-earth magnet. The manufacturing method includes: manufacturing a sintered body having by performing pressing on a magnetic powder for a rare-earth magnet; and manufacturing a rare-earth magnet by putting the sintered body in a plastic working mold and by performing hot plastic working on the sintered body while pressing the sintered body to give anisotropy to the sintered body. The sintered body has a cuboid shape and includes at least one recessed side face that has a recessed portion curved inward. The plastic working mold includes a lower die, a side die forming a rectangular frame of four side faces, and an upper die slidable in the side die. The hot plastic working is hot upsetting.

According to the aspect of the present invention, by providing the recessed portion curved inward, deformation amounts of given parts on the side face including the recessed portion are adjusted in a course of deformation of the sintered body in the hot upsetting while top and bottom faces of the sintered body receive shearing frictional forces from the upper die and the lower die. As a result, uniformity of residual magnetization improves.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
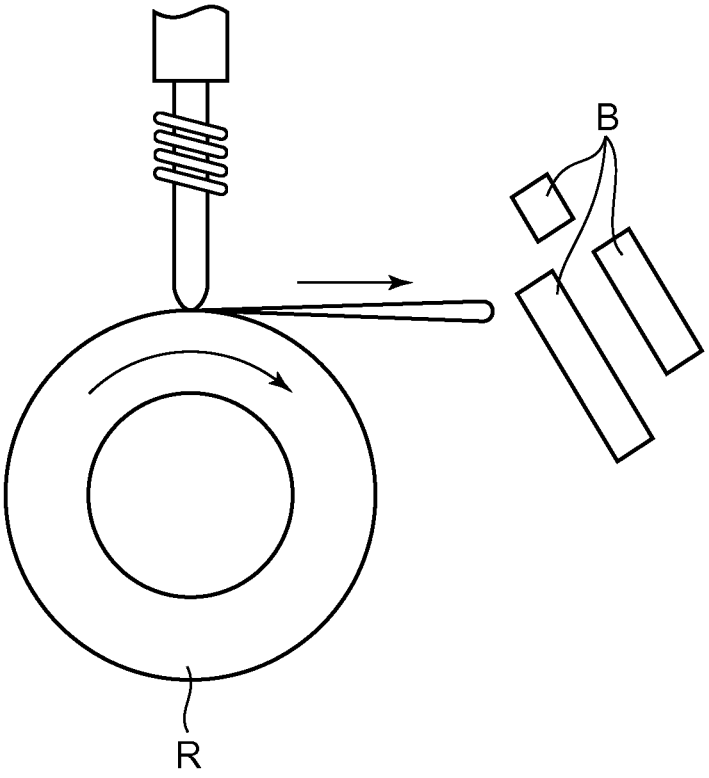
FIG. 1 is a schematic view to describe a manufacturing method of a magnetic powder to be used in a first step of a manufacturing method of a rare-earth magnet according to some embodiments of the present invention.

Initially described is an outline of an embodiment of the present invention. A manufacturing method of a rare-earth magnet according to the embodiment of the present invention includes: manufacturing a sintered body; and manufacturing a rare-earth magnet by performing hot upsetting on the sintered body. The sintered body is manufactured by performing pressing on a magnetic powder for a rare-earth magnet. The sintered body has a cuboid shape including at least one recessed side face having a recessed portion curved inward. The recessed portion may be formed after the pressing. In the hot upsetting, the sintered body is put in a plastic working mold, and subjected to hot plastic working so as to obtain magnetic anisotropy. The plastic working mold includes a lower die, a side die forming a rectangular frame of four side faces, and an upper die slidable in the side die.

In the embodiment, in the hot upsetting, a whole area of the recessed side face may substantially simultaneously come in contact with a corresponding side face of the side die after deformation of the sintered body.

According to the above configuration, at the time when the side face comes in contact with the side die, a whole area of the side face can come in contact with the side die substantially simultaneously.

In the above configuration, a whole area of at least one side face of the sintered body comes in contact with the side die substantially simultaneously, so that deformation thereof is restricted here and a shape thereof is defined. Accordingly, a restriction degree from the side die becomes generally uniform on the whole area of the at least one side face of the sintered body, so that strains to be introduced are generally uniform. As a result, uniformity of residual magnetization improves.

Here, to "come in contact substantially simultaneously" includes: a case where a whole area of that side face of the sintered body which includes the recessed portion comes in contact with the side die simultaneously; and a case where given parts of that side face of the sintered body which includes the recessed portion come in contact with the side die with time differences, which do not cause ununiformity in residual magnetization between the given parts.

In the embodiment of the present invention, the sintered body may be manufactured by use of a molding die including a projection portion corresponding to the recessed portion so that the recessed portion is formed on a desired side face of the sintered body by pressing.

In a case where the recessed portion is formed by cutting or the like on a desired side face of the sintered body manufactured by pressing, unexpected strains may be introduced in the sintered body at the time of cutting. Further, the cutting or the like may reduce a material yield. According to the above configuration, it is possible to restrain the reduction in the material yield due to the cutting or the like.

In the embodiment of the present invention, the sintered body may be manufactured by performing hot press working on a magnetic powder.

The plastic working mold to be used in the hot upsetting is constituted by an upper die, a lower die, and a rectangular frame-shaped side die including four side faces, and the sintered body is put in a cavity of the sealed plastic working mold, and hot upsetting is performed thereon. That is, according to the embodiment of the present invention, it may be considered that the rare-earth magnet is manufactured by a closed die forging method. In the hot upsetting, at the time when the upper die slides relative to the lower die so that the upper die and the lower die come in contact with top and bottom faces of the sintered body, gaps are formed between the side die and four side faces constituting the sintered body having a cuboid shape. A magnitude of the gaps may be set according to a processing rate and strains introduced into the sintered body.

By performing the hot upsetting, the four side faces of the sintered body laterally expand in a non-restriction state, so as to come in contact with four side faces of the side die, respectively, and thus, four flat side faces of a rare-earth magnet manufactured by the hot upsetting are defined.

The sintered body having a cuboid shape includes a pair of side faces along a longitudinal direction and a pair of side faces along a short direction. At the time when the sintered body is deformed in a state where the top and bottom faces thereof are restricted by the upper die and the lower die, the side faces along the longitudinal direction, in particular, causes a large difference in a lateral deformation amount between an end region thereof and a central region thereof. Accordingly, although the recessed portion may be provided in all of the four side faces, the recessed portion may be provided in at least the pair of opposed side faces along the longitudinal direction or at least one of the pair of side faces along the longitudinal direction. Note that, as for the side faces along the short direction, when respective deformation amounts of given parts of the side faces due to open die forging are examined, the respective deformation amounts of the given parts are generally not different from each other so much, which depends on a magnitude of the side faces along the short direction though. Accordingly, even if the recessed portions are not provided in those side faces, it is possible for whole areas of the side faces to come in contact with the side die substantially simultaneously.

For example, in a case where the recessed portions are provided in the pair of side faces along the longitudinal direction, the recessed portions may be provided in central regions of these two side faces. According to this configuration, the two side faces come in contact with their corresponding side faces of the side die substantially simultaneously, so that uniform strains can be introduced into whole areas of the two side faces along the longitudinal direction.

Here, the recessed portion may extend from both ends of the side face in the longitudinal direction, so that a groove height (depth) thereof may become maximal at a central position of the side face. Alternatively, the recessed portion may be provided in a central region of t/3 or a central region of t/2 relative to a longitudinal length t of the side face. It may be considered that the "central region" in the present specification includes various configurations described above.

Further, a friction coefficient between the plastic working mold and the sintered body, a material physical property of the sintered body, a dimension of the sintered body, a processing rate in the hot upsetting, and deformation amounts of given parts of the sintered body in the hot upsetting may be found in advance, so that a shape of the recessed portion may be set based on these various elements. Note that the "processing rate" can be expressed by $(1-h2/h1)\times100(\%)$ at the time when a workpiece having a height h1 is smashed in a height direction so as to form a workpiece having a height h2.

Further, in the embodiment of the present invention, a sintered body manufactured in a first step may include a projection portion provided in a central region of at least one of a top face and a bottom face of the sintered body so as to be curved outward from the sintered body.

For example, by providing the projection portion curved outward (upward), i.e., a portion expanding outward, on the top face of the sintered body, the upper die sliding downward comes in contact with the projection portion first, and then comes in contact with a whole area of the top face sequentially. Accordingly, as compared with a case where the upper die makes contact with the whole area of the top face of the sintered body simultaneously, it is possible to reduce a contact area between the upper die and the top face of the sintered body at the time of given contact, thereby making it possible to reduce a shearing frictional force caused between the sintered body and the upper die. Due to the reduction in the shearing frictional force, it is possible to introduce generally uniform strains into the whole area of the top face of the sintered body, thereby making it possible to attain generally uniform residual magnetization on the whole area of the top face of the sintered body.

Further, a friction coefficient between the plastic working mold and the sintered body, a material physical property of the sintered body, a dimension of the sintered body, a processing rate in the hot upsetting, and deformation amounts of given parts of the sintered body in the hot upsetting may be found in advance, so that a shape and a dimension of the projection portion may be set based on these various elements.

For example, a sintered body having a predetermined dimension with a cuboid shape according to a processing rate to be applied, with respect to a rare-earth magnet with a cuboid shape and a dimension to be finally manufactured, is manufactured. The sintered body is subjected to hot upsetting by an open die forging method at the above processing rate with the use of an actually used plastic working mold, and a deforming state and a deformation amount of each side face are measured. In general, centers of a pair of side faces of the sintered body along its longitudinal direction are curved outward. In view of this, by forming recessed portions recessed inwardly according to the deforming states, that is, by forming recessed portions recessed inwardly so as to have shapes reversed to the shapes thus deformed outward, the recessed portions can expand prior to the other parts at the time when the sintered body is subjected to the hot upsetting. Hereby, at the time when the sintered body comes in contact with the side die, whole areas of the side faces of the sintered body can come in contact with the side die substantially simultaneously. Note that, strictly speaking, in a course of performing the hot upsetting on the sintered body, a volume of the sintered body as a precursor of a rare-earth magnet to be manufactured is changed into a volume of the rare-earth magnet to be manufactured. In view of this, a dimension of the recessed portion may be set by multiplying a deformation amount of the sintered body in the open die forging by a correction factor in consideration of the volume change.

Note that it is desirable that the recessed portion be provided at a central position of the side face of the sintered body. Further, it is desirable that the projection portion be also provided at a central position of the top face or the bottom face of the sintered body. By providing the recessed portion or the projection portion at the central position of the respective face, it is possible to effectively adjust strains to be generally uniformly introduced into a whole area of the side face, the top face, or the bottom face of the sintered body.

Further, in the embodiment of the present invention, in a step (hereinafter, also referred to as a second step in some cases) of manufacturing a rare-earth magnet, four side faces of the sintered body may come in contact with the side die substantially simultaneously.

When the four side faces of the sintered body come in contact with the side die substantially simultaneously, pressures received by all the side faces from the side die become at the same level, so that strains at the same level are introduced therein. Accordingly, it is possible to attain generally uniform residual magnetization on all the side faces.

As is understood from the above description, according to the manufacturing method of the embodiment of the present invention, a curved recessed portion is formed in at least one of four side faces constituting the sintered body in the hot upsetting. On this account, in a course of deformation of the sintered body in the hot upsetting while the top and bottom faces of the sintered body receive shearing frictional forces from the upper die and the lower die, deformation amounts of given parts on the side face including the recessed portion are adjusted. Accordingly, at the time when the side face comes in contact with the side die, a whole area of the side face can come in contact with the side die substantially simultaneously. As such, when the whole area of the side face of the sintered body comes in contact with the side die substantially simultaneously, deformation of the sintered body is restricted and a shape of the sintered body is defined. As a result, a restriction degree from the side die becomes generally uniform on the whole area of the side face of the sintered body, so that strains to be introduced become generally uniform. Thus, according to the embodiment of the present invention, a rare-earth magnet having uniform residual magnetization can be manufactured.

With reference to the drawings, the following describes an embodiment of a manufacturing method of a rare-earth magnet of the present invention in detail. Note that the following deals with a case where a rare-earth magnet as an object to be manufactured by the manufacturing method illustrated herein is a nanocrystalline magnet (with a particle diameter of around 300 nm or less). However, a rare-earth magnet as an object to be manufactured by the manufacturing method of the embodiment of the present invention is not limited to the nanocrystalline magnet, but includes a sintered magnet having a particle diameter of 300 nm or more, a sintered magnet having a particle diameter of 1 μm or more, and the like.

Figure 2:
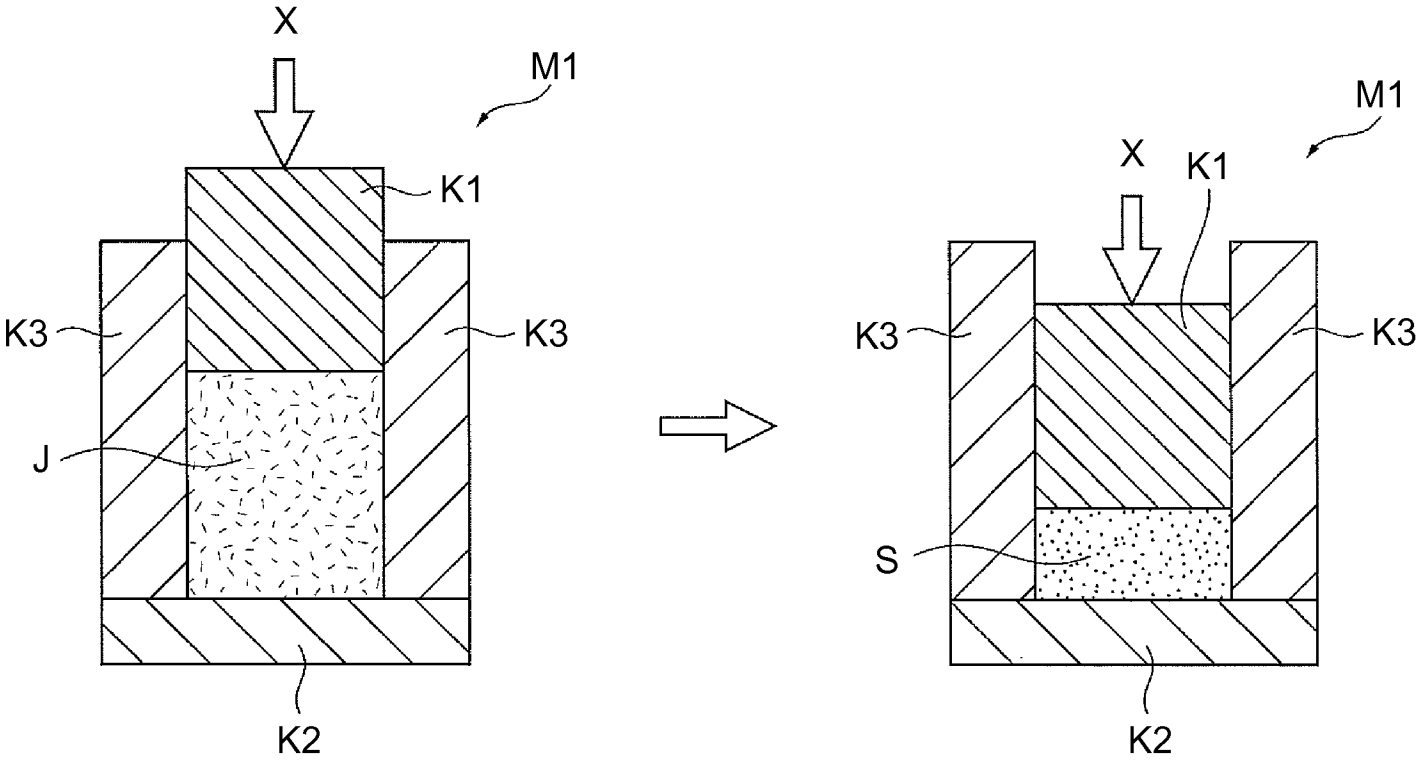
FIG. 2 is a view to describe the first step of the manufacturing method according to some embodiments of the present invention.
Figure 6A:
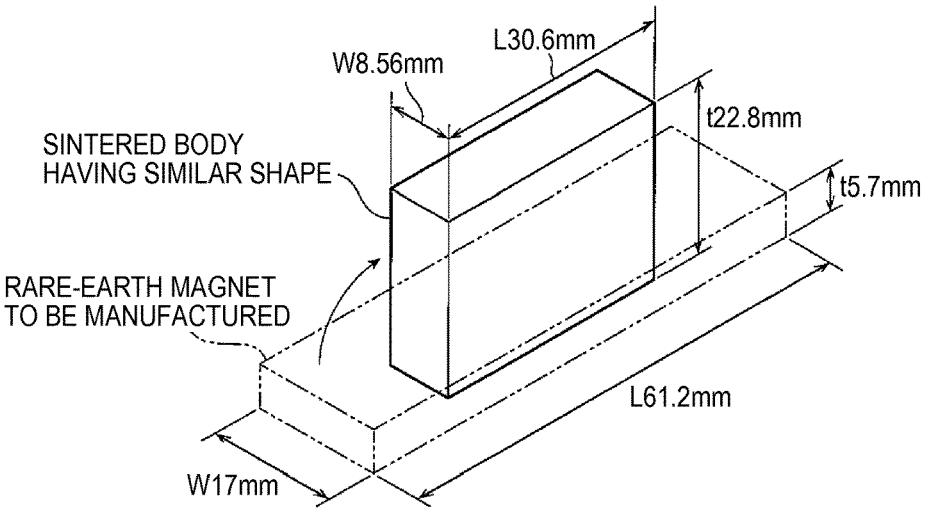
FIGS. 6A, 6B, and 6C are views sequentially illustrating processes to design a recessed portion according to some embodiments of the present invention.
Figure 6B:
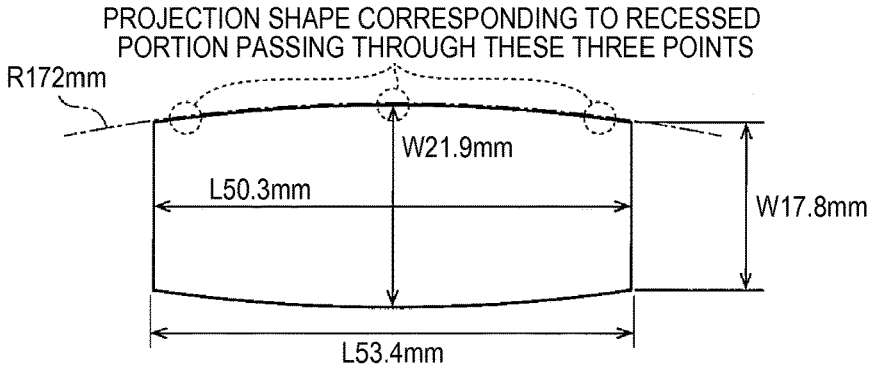
Figure 6C:
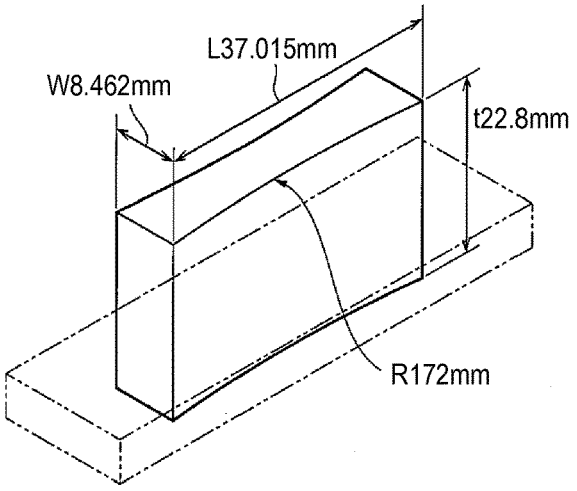
Figure 7:
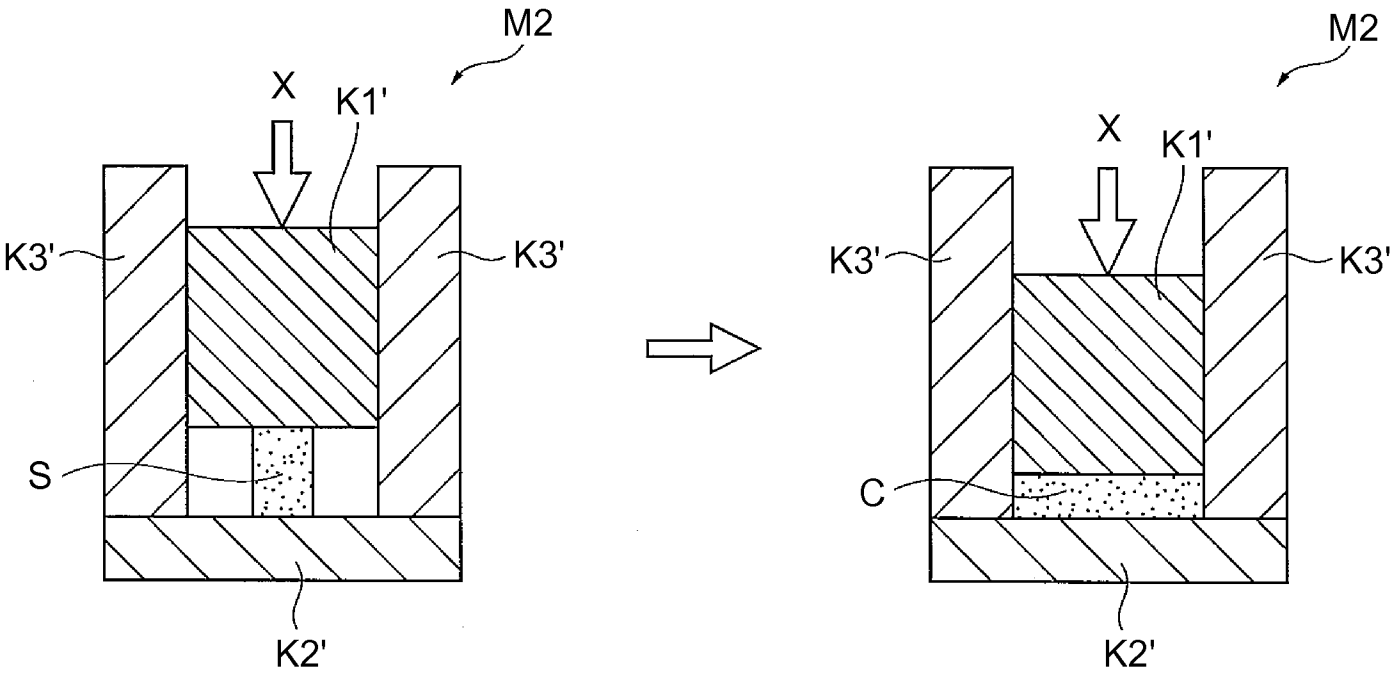
FIG. 7 is a view to describe a second step of the manufacturing method according to some embodiments of the present invention.

FIG. 1 is a schematic view to describe a manufacturing method of a magnetic powder to be used in a first step of the manufacturing method of the rare-earth magnet according to the embodiment of the present invention. FIG. 2 is a view to describe the first step of the manufacturing method, and FIGS. 4A, 4B and FIGS. 5A, 5B are perspective views respectively illustrating a sintered body SI, a sintered body SII, a sintered body SIII, and a sintered body SIV before hot upsetting according to the embodiment of the present invention. Further, FIGS. 6A, 6B, and 6C are views sequentially illustrating processes of a design method of designing a recessed portion of a first sintered body, and FIG. 7 is a view to describe a second step of the manufacturing method.

As illustrated in FIG. 1, in a furnace (not shown) under an Ar-gas atmosphere in which a pressure is decreased to 50 kPa or less, for example, a melt spinning method using a single roll is performed such that an alloy ingot is melted at a high frequency and molten metal having a composition that provides a rare-earth magnet is jetted to a copper roll R, so as to manufacture rapidly cooled strips B (rapidly cooled ribbons). The rapidly cooled strips B are roughly crushed so as to manufacture a magnetic powder J.

As illustrated in FIG. 2, the magnetic powder J with a dimension of around 200 μm or less is filled into a cavity of a molding die M1 constituted by a lower die K2, a side die K3, and an upper die K1 slidable in the side die K3. While the magnetic powder J is pressed by the upper die K1 (in an X-direction), a current is flowed in a pressure direction so as to perform heating by current application, thereby manufacturing a sintered body SI which is constituted by a Nd—Fe—B main phase of a nanocrystal structure (with a grain size of around 50 nm to 200 nm) and a grain boundary phase of Nd-X alloy (X: metal element) provided around the main phase and which is configured such that recessed portions are formed in a pair of side faces along a longitudinal direction, among four side faces constituting a cuboid shape, for example (the first step). Note that a shape of the sintered body thus molded by the molding die M1 will be described later with reference to FIGS. 4, 5.

Here, the Nd-X alloy constituting the grain boundary phase is an alloy including Nd and at least one of Co, Fe, Gd, and the like, and is at least one of Nd—Co, Nd—Fe, Nd—Ga, Nd—Co—Fe, and Nd—Co—Fe—Ga, or a mixture of two or more thereof in combination. The Nd—X alloy includes Nd abundantly.

Figure 3:
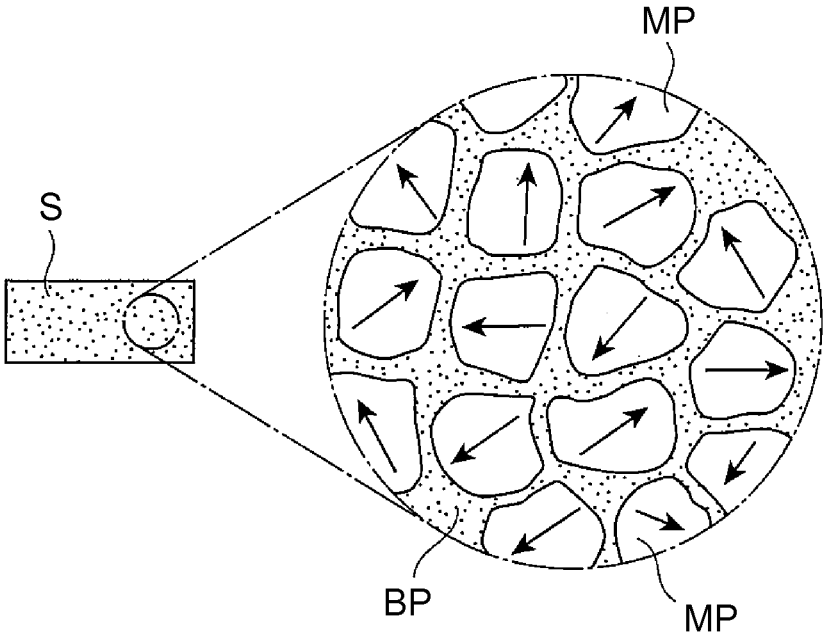
FIG. 3 is a view to describe a microstructure of a sintered body manufactured in the first step.

As illustrated in FIG. 3, the sintered body SI exhibits an isotropic crystal structure in which the grain boundary phase BP is filled between nanocrystal grains MP (the main phase).

In order to manufacture the sintered body SI in which at least one side face includes a recessed portion in the first step, a projection portion (not shown) is formed on that side face of the side die K3 of the molding die M1 illustrated in FIG. 2 which corresponds to that side face of the sintered body SI which includes the recessed portion.

Figure 4A:
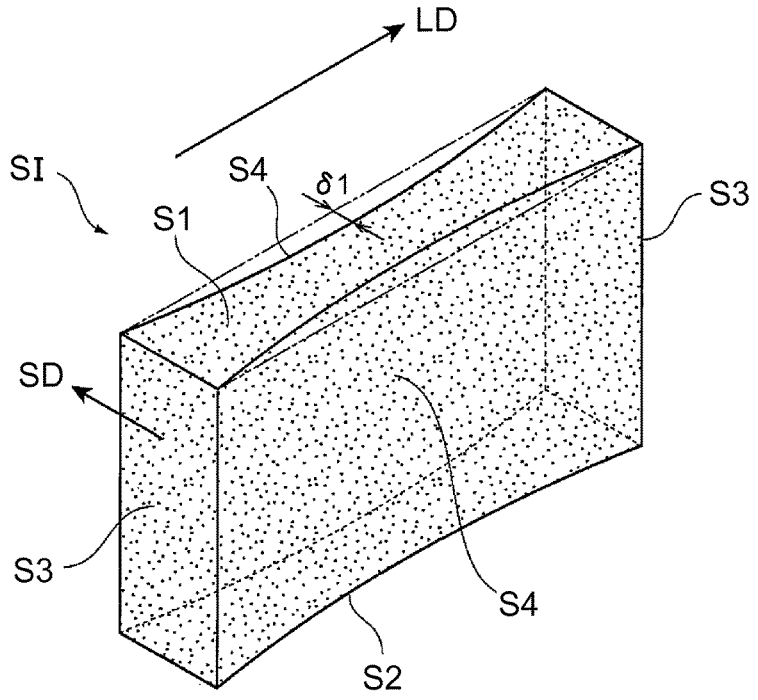
FIGS. 4A and 4B are perspective views each illustrating a sintered body before hot upsetting according to some embodiments of the present invention.

Next will be described a plurality of sintered bodies having different shapes with reference to FIGS. 4, 5. A sintered body SI illustrated in FIG. 4A is configured such that curve-shaped recessed portions recessed toward a central side of the sintered body SI are formed on a pair of side faces S4 along a longitudinal direction LD.

In the sintered body SI, a top face S1, a bottom face S2, a pair of side faces S3 along a short direction SD are flat surfaces, and only the pair of side faces S4 along the longitudinal direction LD have the curve-shaped recessed portions recessed inward by δ1 at respective central positions.

By forming the curve-shaped recessed portions partially on the side faces of the sintered body SI as such, more particularly, by forming the curve-shaped recessed portions thereon so that they are recessed maximally at central positions of the side faces, deformation amounts of given parts on the side faces S4 are adjusted by the recessed portions in a course of deformation of the sintered body SI in the hot upsetting in the after-mentioned second step while the top face S1 and the bottom face S2 of the sintered body SI receive shearing frictional forces from the upper die and the lower die. Hereby, at the time when the side faces S4 come in contact with the side die of the plastic working mold, whole areas of the side faces can come in contact with the side die substantially simultaneously. Particularly, those central parts of the side faces S4 which are hard to be plastically fluidized are plastically fluidized successfully, which leads to generally uniform residual magnetization on entire areas of the side faces S4.

Figure 4B:
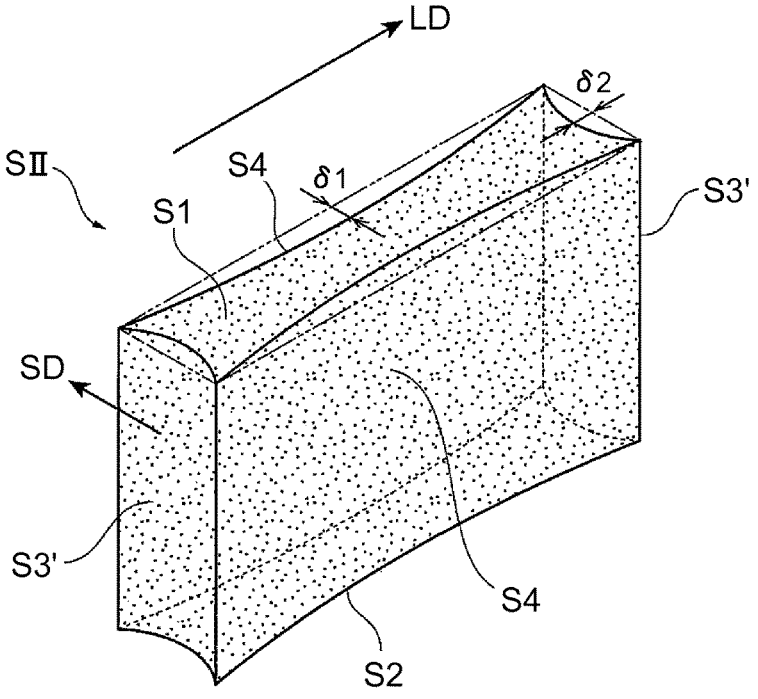

In the meantime, the sintered body SII illustrated in FIG. 4B is configured such that, in addition to a pair of side faces S4 along a longitudinal direction LD, a pair of side faces S3' along a short direction SD have curve-shaped recessed portions recessed inward by δ2 at respective central positions.

According to the study of the inventors of the present invention, in a case where the pair of side faces along the short direction SD have a short side length (a short length of sides extending along the short direction SD), a large difference in the deformation amount does not occur between given parts of the side faces in the hot upsetting.

Accordingly, it is possible for the given parts of the side faces to come in contact with the side die substantially simultaneously in the hot pressing. Accordingly, it is not necessary to provide the recessed portions, unlike the side faces along the longitudinal direction LD. However, in a case where the side length of the pair of side faces along the short direction SD is relatively long and given parts of the side faces cannot come in contact with the side die substantially simultaneously in the hot pressing, it is preferable to form the recessed portions on the side faces S3' along the short direction SD like the sintered body SII.

Figure 5A:
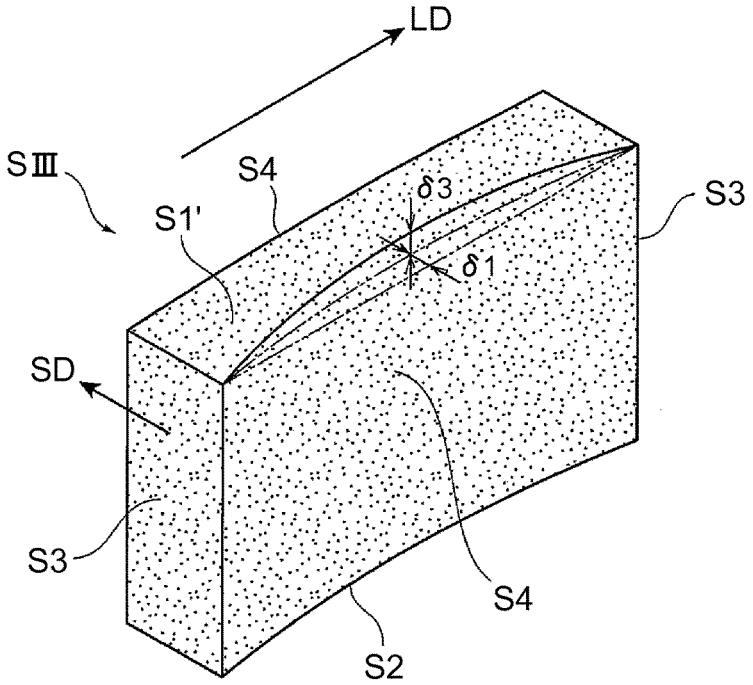
FIGS. 5A and 5B are perspective views each illustrating a sintered body before hot upsetting according to some embodiments of the present invention.

In the meantime, a sintered body SIII illustrated in FIG. 5A is configured such that projection portions expanding in a curved shape by δ3 toward an outer side relative to the sintered body SIII are formed on a top face S1', in addition to recessed portions formed on a pair of side faces S4 along a longitudinal direction LD.

By providing the projection portion curved upward to expand by δ3 on the top face S1' of the sintered body SIII, that upper die of the plastic working mold which slides downward comes in contact with the top face S1' of the sintered body SIII sequentially from the projection portion in the hot upsetting, so as to sequentially come in contact with a whole area of the top face S1'. Accordingly, as compared with a case where the upper die of the plastic working mold makes contact with the top face S1' of the sintered body SIII simultaneously, it is possible to reduce a contact area between the upper die and the top face S1' of the sintered body SIII at the time of given contact, thereby making it possible to reduce a shearing frictional force caused between the sintered body SIII and the upper die. Due to the reduction in the shearing frictional force, it is possible to introduce generally uniform strains into the whole area of the top face S1' of the sintered body SIII, thereby making it possible to attain uniform residual magnetization on the whole area of the top face of the sintered body SIII. Further, in a thickness direction at a central region of the sintered body SIII, uniform residual magnetization can be attained in given parts of a central part, a top side relative to the central part, and a top side.

According to the study of the inventors of the present invention, by providing the projection portion on the top face S1' in addition to the recessed portions provided on the side faces S4, residual magnetization of a rare-earth magnet manufactured by the hot upsetting is further increased.

Figure 5B:
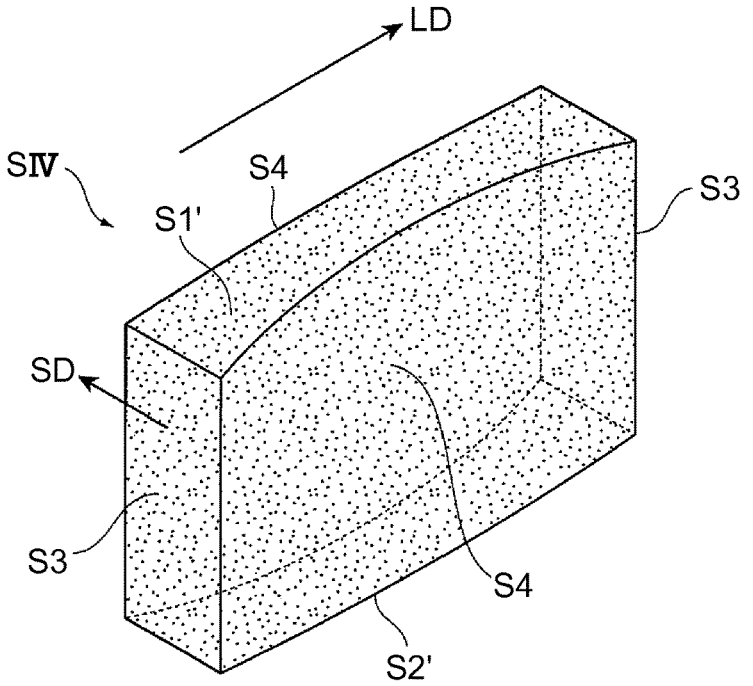

Further, a sintered body SIV illustrated in FIG. 5B is configured such that a projection portion curved outward (downward) is further formed on a bottom face ST in addition to the configuration of the sintered body SIII.

Next will be described a designing method of shapes and dimensions of the recessed portions to be formed on the sintered bodies SI, SII, SIII, SIV illustrated in FIGS. 4, 5, with reference to FIGS. 6A, 6B, 6C. Note that a dimension and a processing rate of the sintered body to be illustrated herein are just examples, and various dimensions and processing rates can be set.

Initially, as illustrated in FIG. 6A, in order to attain a uniform volume in consideration of a processing rate of 75% with respect to a dimension (a short-side length (W): 17 mm, a longitudinal length (L): 61.2 mm, a thickness (t): 5.7 mm) of a rare-earth magnet to be finally manufactured, a sintered body having a similar reduced shape with a longitudinal length (L) and a short-side length (W) while maintaining a ratio between the longitudinal length (L) and the short-side length (W) of the dimension of the rare-earth magnet is formed.

Free upsetting is performed on the sintered body so as to manufacture a temporary rare-earth magnet.

A top-view shape of the temporary rare-earth magnet thus manufactured by the free upsetting is illustrated in FIG. 6B. In consideration of a friction coefficient (μ) between the plastic working mold and the sintered body, a material physical property (a stress-strain characteristic, a temperature characteristic, a strain rate) of the sintered body, a dimension (L: a longitudinal length, W: a short-side length, H: thickness) of the sintered body, and a processing rate (F) by adding molding conditions thereto, a shape of projection portions formed on a side face so as to expand outward is determined first. Note that, as illustrated in FIG. 6B, the shape of the projection portion expanding outward is set by an approximate curve passing through three points in total at a center and right and left ends in the top-view shape of the temporary rare-earth magnet.

Then, as illustrated in FIG. 6C, maximum values and minimum values of the longitudinal length (L) and the short-side length (W) obtained in the free upsetting are measured. In consideration of easiness and difficulty of deformation of the sintered body in the hot upsetting (the sintered body is easy to be deformed in the longitudinal direction but is hard to be deformed in the short direction) in regard to the longitudinal length (L) and the short-side length (W), correction factors relative to the longitudinal length (L) and the short-side length (W) are determined.

Here, in a case where the shape of the projection portion illustrated in FIG. 6B is reversed toward an inner side relative to the magnet so as to form a recessed shape, the volume decreases. Accordingly, with the use of the correction factor for the longitudinal length and the correction factor for the short-side length, which have been already found, the longitudinal length (L) and the short-side length (W) are corrected so that a deviation from a design volume of the rare-earth magnet is 0.1% or less, thereby setting a shape of a recessed portion to be formed on the side face of the sintered body as illustrated in FIG. 6C. Note that it is desirable to repeatedly perform closed die forging and repeat the correction, so as to find a shape that allows the side faces of the sintered body along the longitudinal direction and the side faces thereof along the short direction to come in contact with the side die of the plastic working mold substantially simultaneously.

The setting method of the shape and the dimension of the recessed portion as illustrated in FIGS. 6A, 6B, 6C is also applicable to setting of a shape and a dimension of the projection portion.

When the shape and the dimension of the recessed portion are set by the setting method of FIGS. 6A, 6B, 6C and the sintered body SI as illustrated in FIG. 4A, for example, is manufactured, the sintered body SI is placed in a plastic working mold M2 constituted by a lower die K2', a side die K3' having a rectangular frame shape including four side faces, and an upper die K1' slidable in the side die K3', and is subjected to hot upsetting (closed die forging) (a pressing direction: X-direction), which is hot plastic working, so as to manufacture a rare-earth magnet C, as illustrated in FIG. 7.

Figure 8:
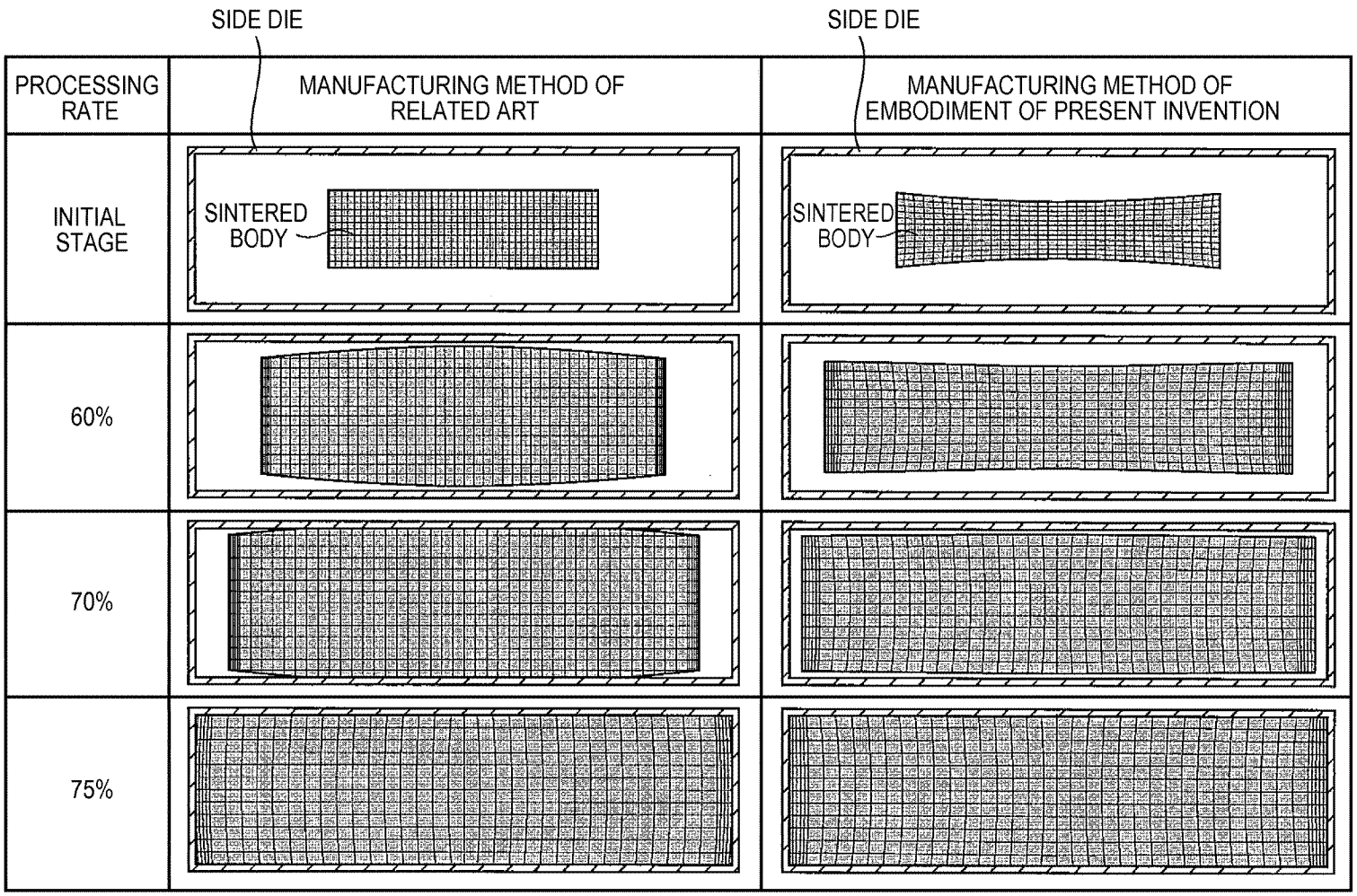
FIG. 8 is a schematic view illustrating a relationship between a sintered body and a side die for each processing rate in hot upsetting by a manufacturing method of a related art and a relationship between a sintered body and a side die for each processing rate in hot upsetting by the manufacturing method according to some embodiment of the present invention.

Here, FIG. 8 illustrates a relationship between a sintered body and a side die for each processing rate in the hot upsetting in a case of a manufacturing method of a related art and in a case of the manufacturing method according to the embodiment of the present invention.

In the manufacturing method of the related art, a sintered body having cuboid shape is put in a side die having a rectangular frame shape. In contrast, according to the manufacturing method of the embodiment of the present invention, a sintered body including recessed portions on side faces along a longitudinal direction is put in a side die having a rectangular frame shape.

In the example illustrated herein, there is a gap between the side die and each side face of the sintered body at a stage of a processing rate of 60%. However, in the manufacturing method of the related art, a gap between the side die and each side face along the longitudinal direction is markedly shorter than a gap between the side die and each side face along a short direction. Then, at a stage of a processing rate of 70%, the each side face along the longitudinal direction comes in contact with the side die, but the gap between the side die and the each side face along the short direction still remains, in the manufacturing method of the related art. In contrast, in the manufacturing method according to the embodiment of the present invention, at the stage of a processing rate of 70%, a gap between the side die and each side face along the longitudinal direction and a gap between the side die and each side face along the short direction are at the same level.

At a stage of a processing rate of 75%, respective side faces of both of the sintered bodies come in contact with respective side dies. In a case of the manufacturing method of the related art, there is no gap between the side die and each side face of the sintered body along the longitudinal direction at the stage of a processing rate of 70%, whereas there is a gap between the side die and each side face along the short direction. Because of this, respective pressures received by the side faces along the longitudinal direction and the side faces along the short direction from the side die and respective plastic flow amounts thereof at the stage of a processing rate of 75% are largely different from each other. As a result, respective strains introduced into respective side faces become greatly different from each other, which cause ununiform residual magnetization between the respective side faces.

In contrast, in a case of the manufacturing method according to the embodiment of the present invention, generally the same gap is formed between the sintered body and the side die at the stage of a processing rate of 70%, so respective pressures received by the side faces along the longitudinal direction and the side faces along the short direction from the side die and respective plastic flow amounts thereof are at the same level at the stage of a processing rate of 75%. As a result, respective strains introduced into respective side faces become at the same level, which attains uniform residual magnetization on the respective side faces.

Figure 9:
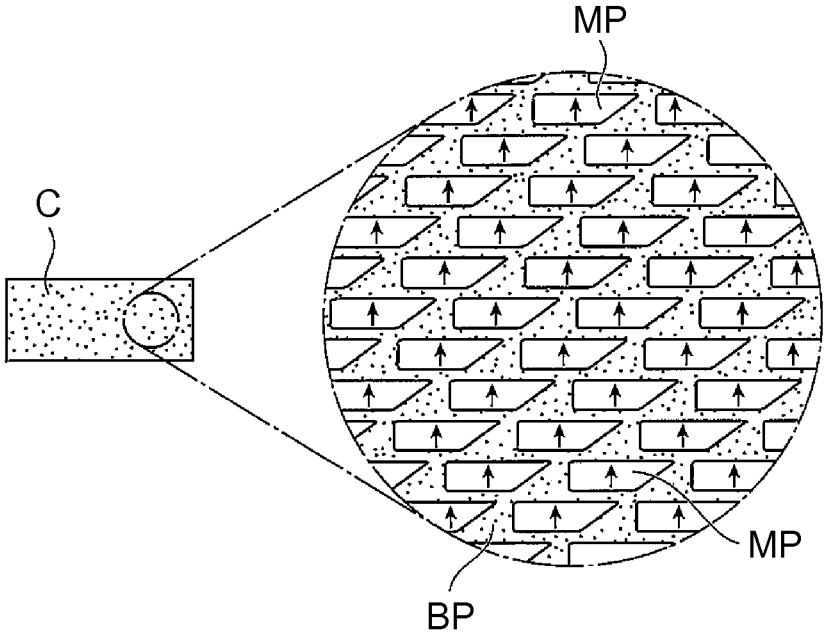
FIG. 9 is a view to describe a microstructure of a rare-earth magnet manufactured in some embodiments of the present invention.

A rare-earth magnet C manufactured by hot plastic working exhibits a magnetically anisotropic crystal structure as illustrated in FIG. 9.

According to the manufacturing method of the embodiment of the present invention, by performing hot upsetting on a sintered body including a recessed portion on a side face so as to cause the side face to come in contact with the side die substantially simultaneously, or by performing hot upsetting on a sintered body including a recessed portion on a side face and a projection portion on a top face or a bottom face so as to cause the side face to come in contact with the side die substantially simultaneously, uniform strains are introduced into a whole area of the sintered body, thereby making it possible to manufacture a rare-earth magnet in which residual magnetization is uniform over the whole area of the sintered body.

The inventors of the present invention carried out an experiment to check an effect of a method (Example 1) of manufacturing a rare-earth magnet by performing hot plastic working on a sintered body including a recessed portion on a side face in closed die forging.

Figure 10:
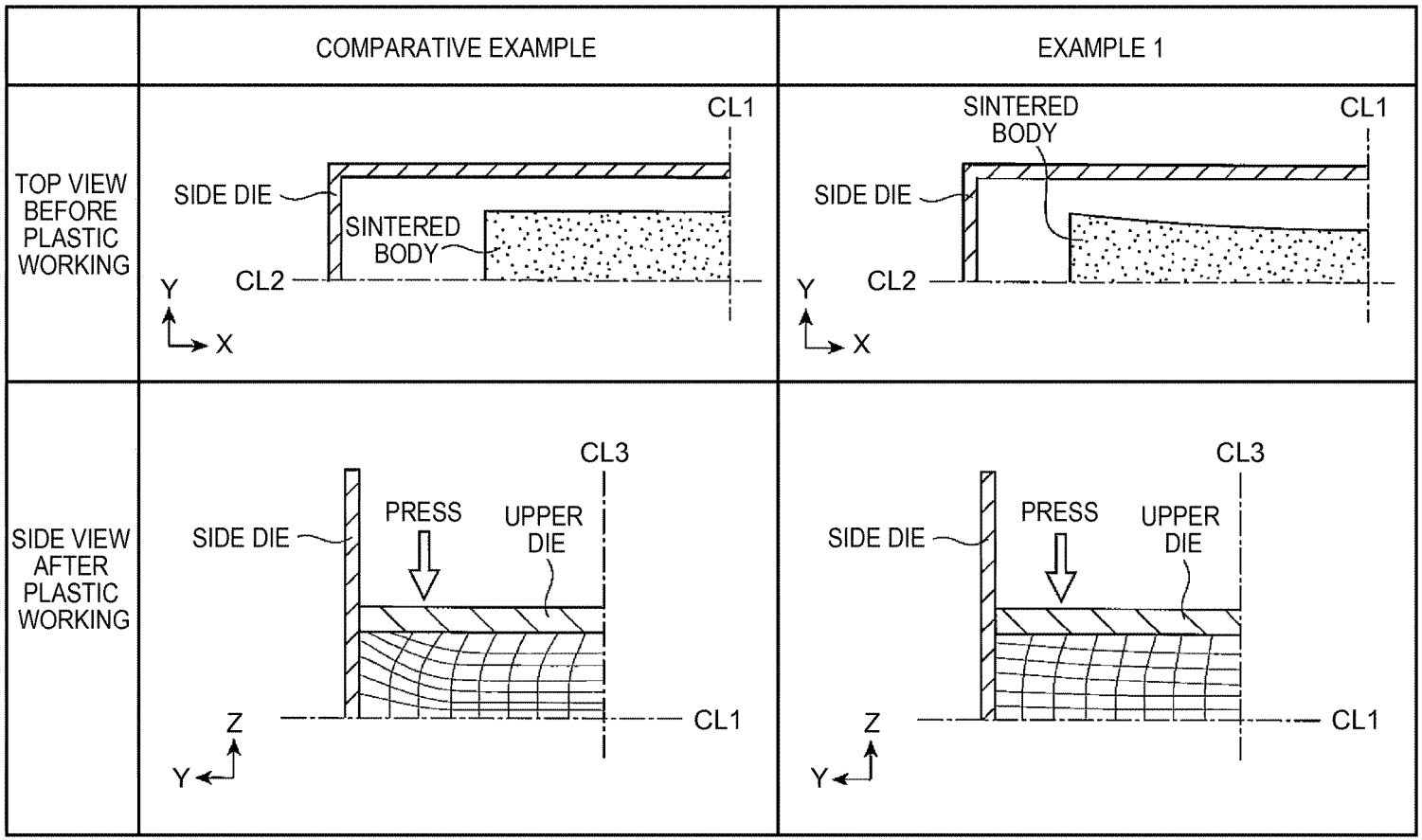
FIG. 10 is a view simulating deforming states inside respective rare-earth magnets after hot upsetting in a comparative example and Example 1 of the present invention.
Figure 11A:
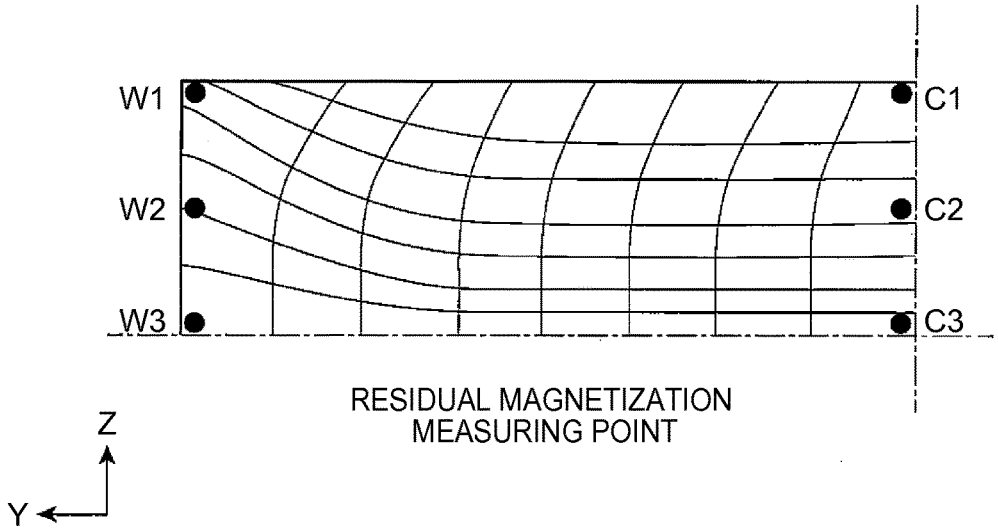
FIG. 11A is a view illustrating the deforming state in the comparative example in association with residual magnetization measuring points.
Figure 11B:
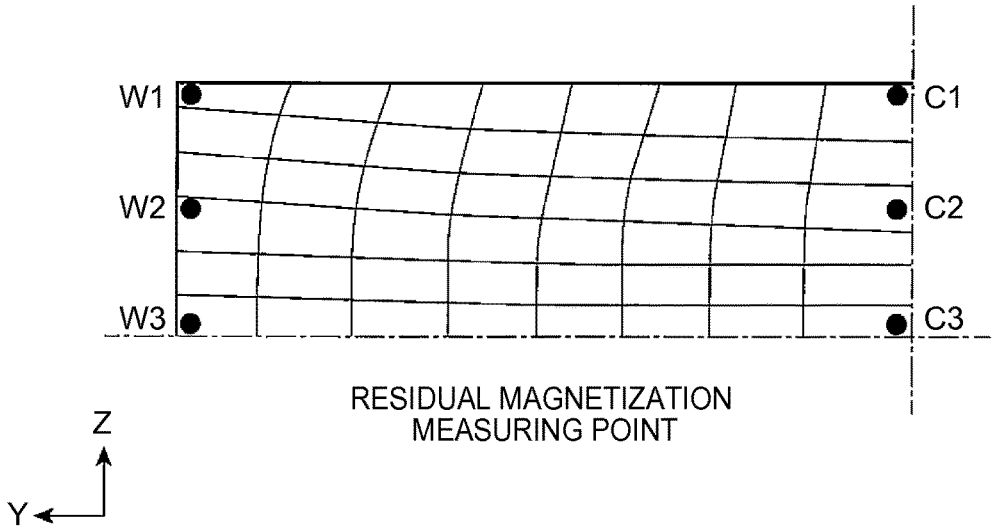
FIG. 11B is a view illustrating the deforming state in Example 1 in association with residual magnetization measuring points.
Figure 12A:
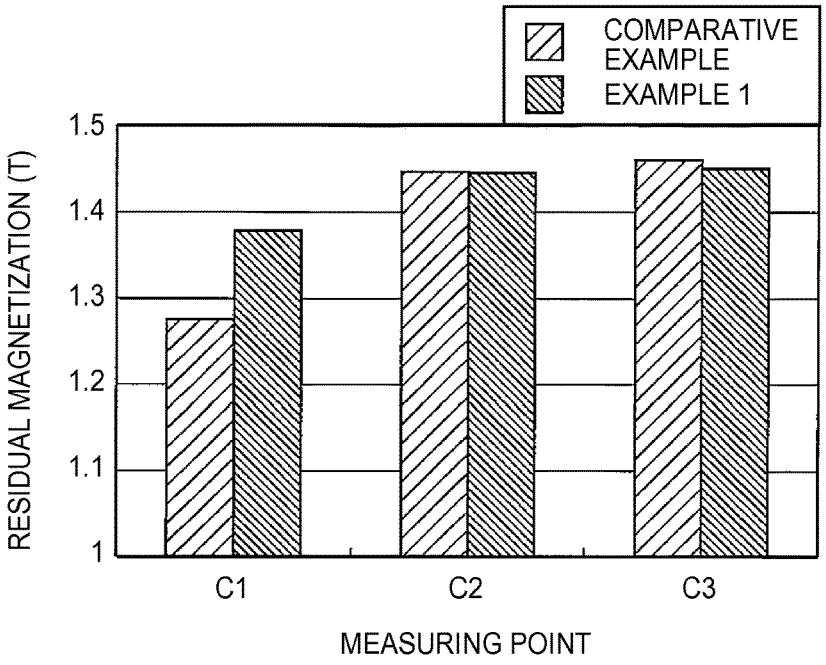
FIG. 12A is a view illustrating measurement results of residual magnetization at respective central positions of the rare-earth magnets of Example 1 and the comparative example.
Figure 12B:
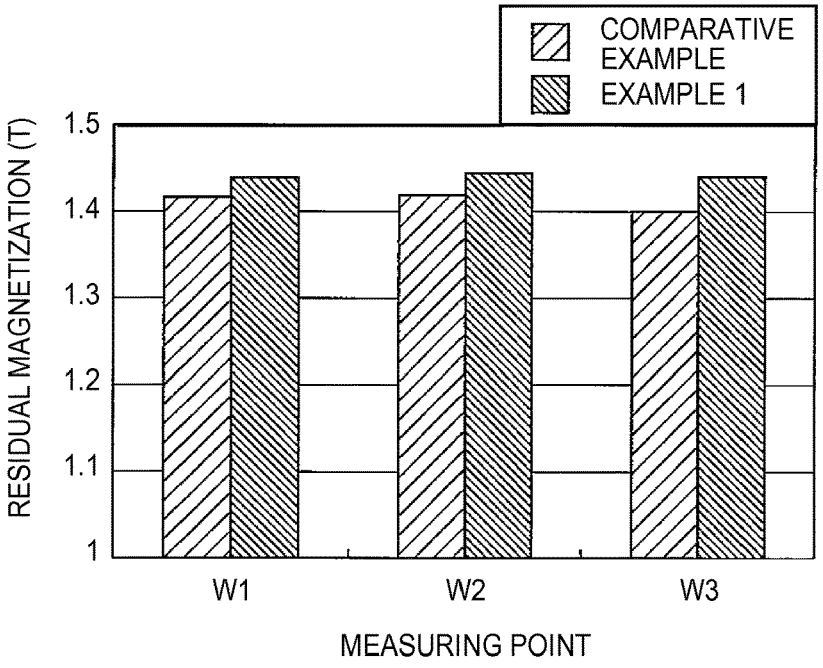
FIG. 12B is a view illustrating measurement results of residual magnetization at respective end positions of the rare-earth magnets of Example 1 and the comparative example.

FIG. 10 is a view simulating deforming states inside respective rare-earth magnets after hot upsetting in a comparative example and in Example 1. Further, FIG. 11A is a view illustrating residual magnetization measuring points in a view illustrating the deforming state in the comparative example, and FIG. 11B is a view illustrating residual magnetization measuring points in a view illustrating the deforming state in Example 1. Further, FIG. 12A is a view illustrating measurement results of residual magnetization at respective central positions of the rare-earth magnets of Example 1 and the comparative example, and FIG. 12B is a view illustrating measurement results of residual magnetization at respective end positions of the rare-earth magnets of Example 1 and the comparative example. Note that FIG. 10 illustrates only ¼ of an entire region in a top view and a side view because four regions are deformed symmetrically with center lines CL1, CL2 and center lines CL1, CL3.

In the deformation of the comparative example as illustrated in FIG. 11A, respective deforming states of respective parts at residual magnetization measuring points C1, C2, C3 in a center and at residual magnetization measuring points W1, W2, W3 in an end are greatly different from each other. In contrast, in the deformation of Example 1 as illustrated in FIG. 11B, respective deforming states of respective parts at residual magnetization measuring points C1, C2, C3 in a center and at residual magnetization measuring points W1, W2, W3 in an end are not so different from each other.

This means that a large difference occurs between respective strains introduced into respective parts in the comparative example, but no difference occurs between respective strains introduced into respective parts in Example 1 .

As a result, as illustrated in FIGS. 12A, 12B, it is demonstrated that residual magnetization of Example 1 is largely improved at a central position, particularly, at an upper measurement position C1, as compare with the comparative example, and residual magnetization is improved at all measuring points at an end position.

The inventors of the present invention carried out an experiment related to a relationship between a processing rate and a radius of a recessed portion, an experiment related to a relationship of a friction coefficient between a plastic working mold and a sintered body with a radius of a recessed portion, and an experiment related to a relationship between material properties of a sintered body and a radius of a recessed portion.

Figure 13:
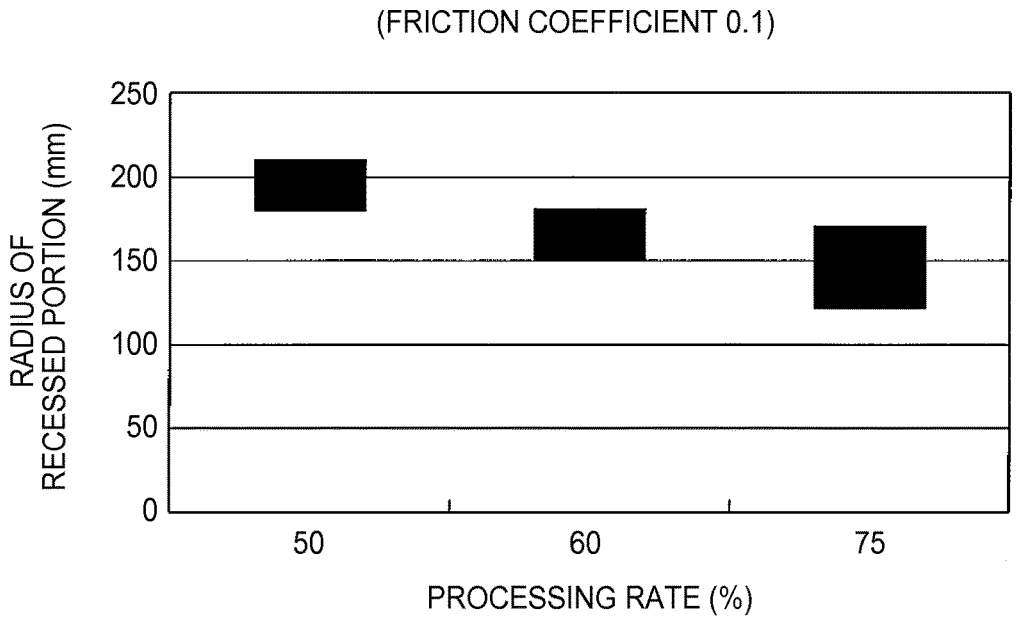
FIG. 13 is a view illustrating an experimental result related to a relationship between a processing rate and a radius of a recessed portion.
Figure 14:
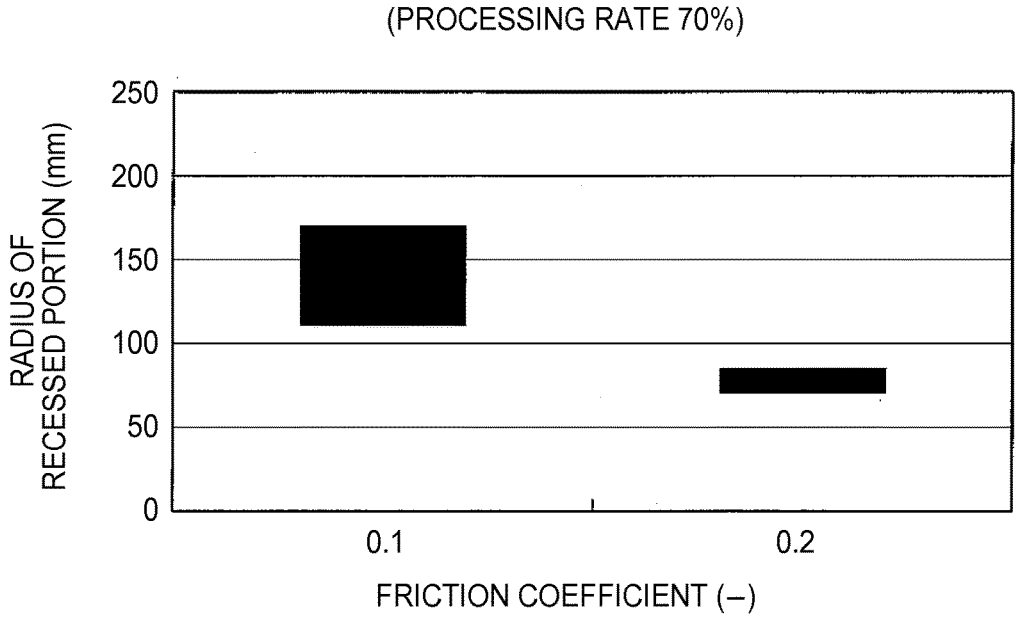
FIG. 14 is a view illustrating an experimental result related to a relationship of a friction coefficient between a plastic working mold and a sintered body with a radius of a recessed portion.
Figure 15:
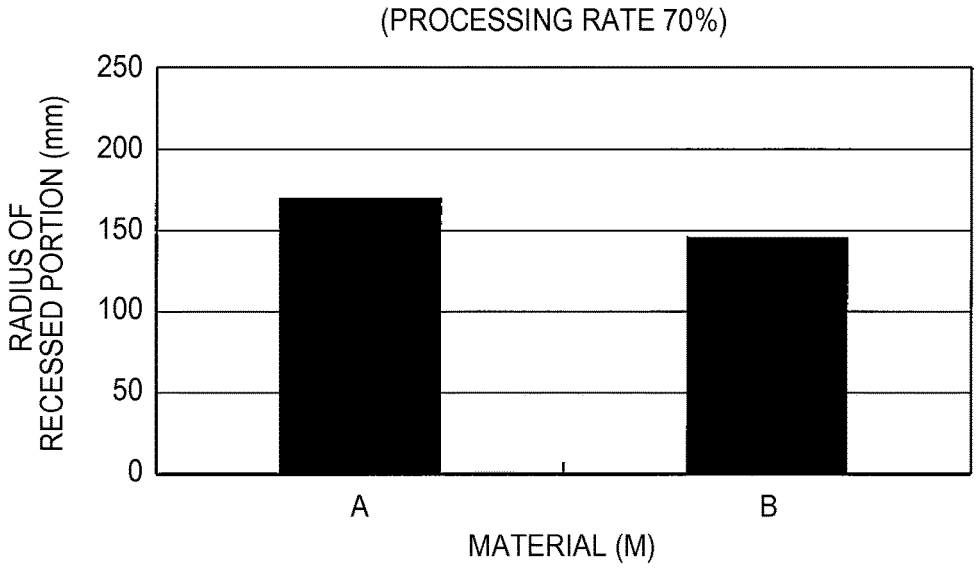
FIG. 15 is a view illustrating an experimental result related to a relationship between material properties of a sintered body and a radius of a recessed portion.

In each of the experiments, a rare-earth magnet having a designed dimension with a short direction length (W) of 14 to 17 mm, a longitudinal length (L) of 56 to 62 mm, and a thickness (t) of 5 to 6 mm was manufactured. FIG. 13 illustrates an experimental result related to the relationship between the processing rate and the radius of the recessed portion, FIG. 14 illustrates an experimental result related to the relationship of the friction coefficient between the plastic working mold and the sintered body with the radius of the recessed portion, and FIG. 15 illustrates an experimental result related to the relationship between the material properties of the sintered body and the radius of the recessed portion. In FIG. 15, materials A, B have different material properties by making composition ratios of Nd—Fe—B rare-earth magnet materials therein different from each other. More specifically, a yield ratio(=yield point/tensile strength) is found from a stress-strain curve at 800° C. Respective yield ratios of the materials A, B at a strain rate of 0.1 are 0.29 and 0.78, and respective yield ratios thereof at a strain rate of 1 are 0.58 and 0.84.

It is found from FIG. 13 that: at a processing rate of 50%, the radius of the recessed portion was 180 to 210 mm; at a processing rate of 60%, the radius of the recessed portion was 150 to 180 mm; and at a processing rate of 75%, the radius of the recessed portion was 120 to 170 mm. As a result, in a case where the processing rate is 75%, which is high, a radius range of the recessed portion increases still more, thereby making it possible to relax securing of accuracy of the recessed portion to be formed on a side face of the sintered body at the time of manufacturing a rare-earth magnet having uniform residual magnetization.

In the meantime, it is found from FIG. 14 that: at a friction coefficient of 0.1, the radius of the recessed portion was 110 to 170 mm; and at a friction coefficient of 0.2, the radius of the recessed portion was 70 to 80 mm. As a result, in a case where the friction coefficient is 0.1, which is low, a radius range of the recessed portion increases still more, thereby making it possible to relaxing securing of accuracy of the recessed portion to be formed on the side face of the sintered body at the time of manufacturing a rare-earth magnet having uniform residual magnetization.

Further, it is found from FIG. 15 that: in a case of the material A, the radius of the recessed portion is up to 170 mm; and in a case of the material B, the radius of the recessed portion is up to around 140 mm. As a result, in a case of the material A having a low yield ratio, the radius range of the recessed portion increases still more, thereby making it possible to relax securing of accuracy of the recessed portion to be formed on the side face of the sintered body at the time of manufacturing a rare-earth magnet having uniform residual magnetization.

The inventors of the present invention carried out an experiment to check an effect of a method (Example 2) of manufacturing a rare-earth magnet by performing hot plastic working on a sintered body including a recessed portion on a side face and a projection portion on a top face in closed die forging. Note that a target to be compared with Example 2 is Example 1 that has been described above.

Figure 16:
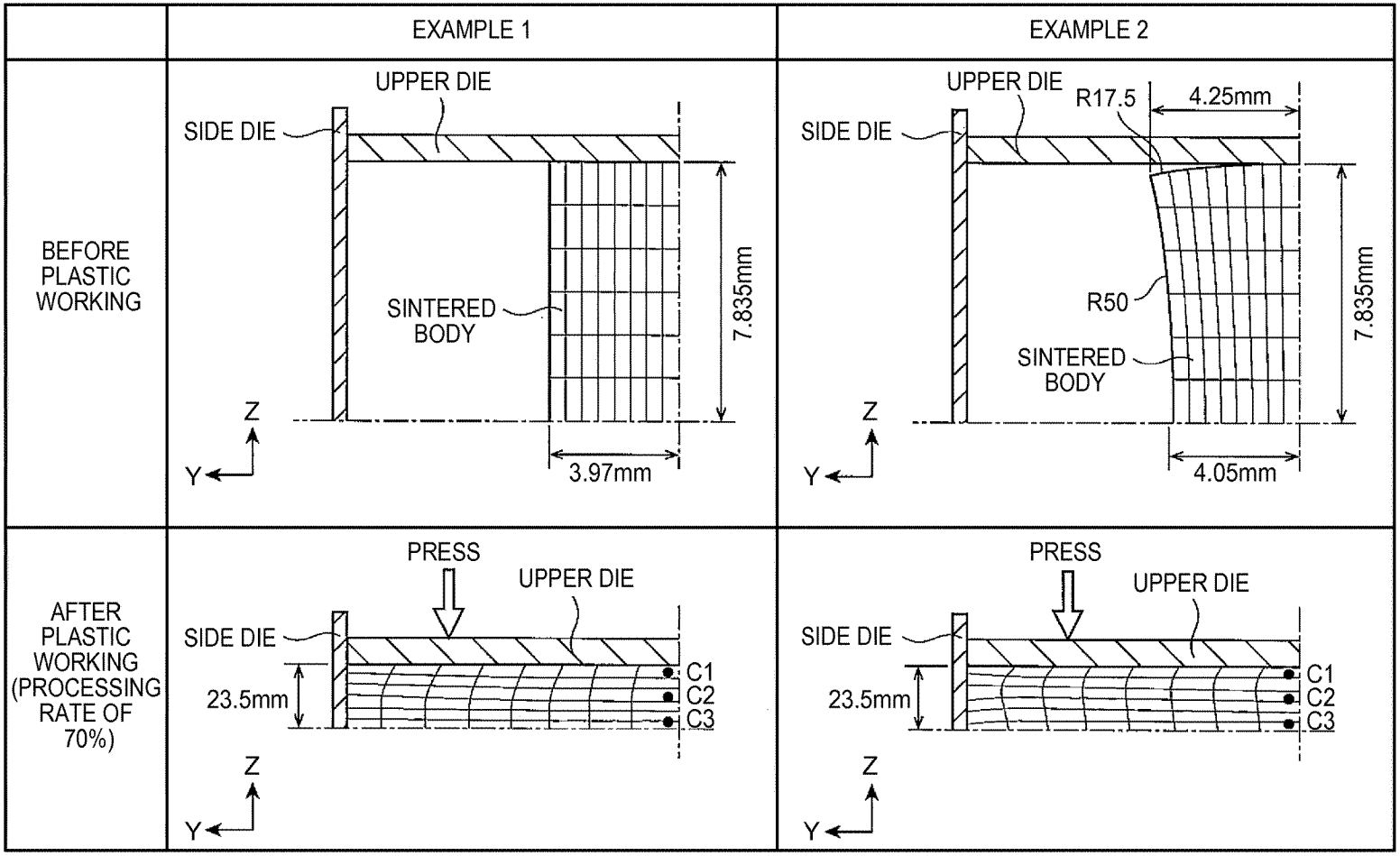
FIG. 16 is a view simulating deforming states inside respective rare-earth magnets after hot upsetting in Example 1 and Example 2 of the present invention.
Figure 17:
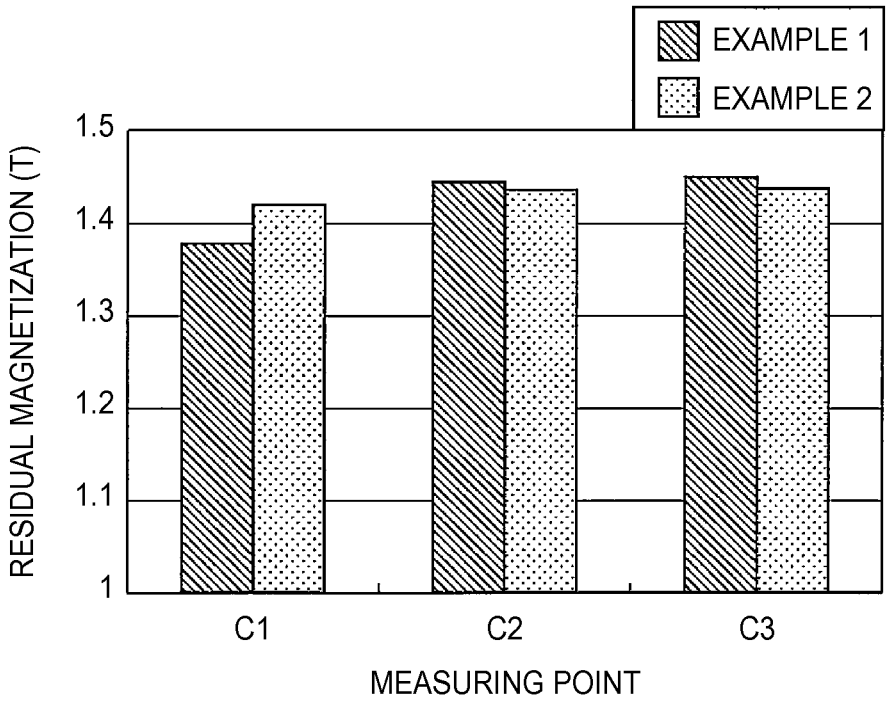
FIG. 17 is a view illustrating measurement results of residual magnetization at respective central positions of the rare-earth magnets of Examples 1, 2.
Figure 18A:
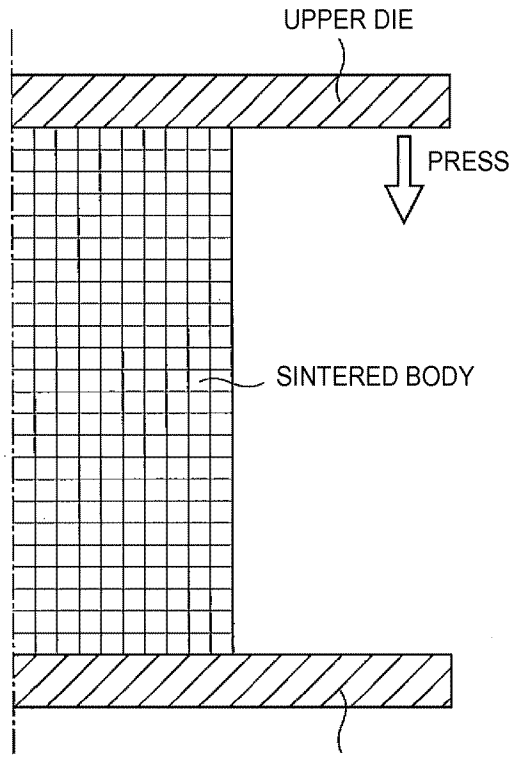
FIG. 18A is a view illustrating an analytic model of a compact sandwiched between an upper die and a lower die before upsetting in a hot upsetting method by upsetting in a related art.
Figure 18B:
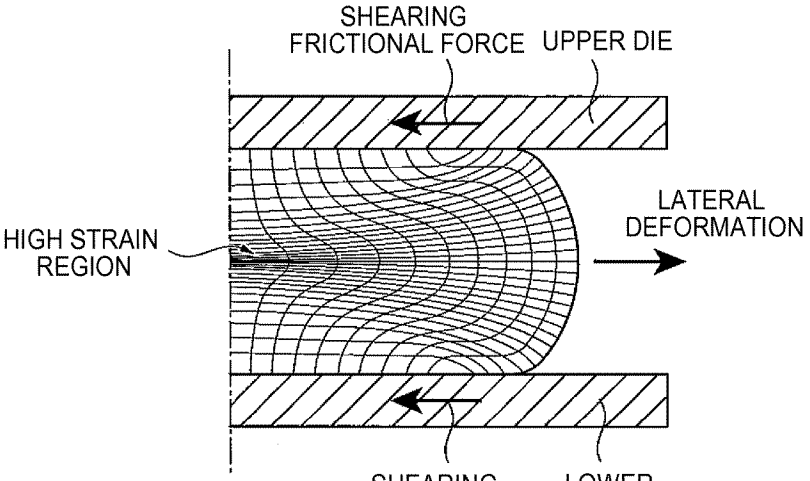
RELATED ART FIG. 18B
FIG. 18B is a view illustrating a deforming state and a distortion distribution (an analysis result) of the analytic model after the upsetting at a processing rate of 50% in the hot upsetting method by the upsetting in the related art.

FIG. 16 is a view simulating deforming states inside respective rare-earth magnets after hot upsetting in Example 1 and in Example 2, and FIG. 17 is a view illustrating measurement results of residual magnetization at respective central positions of the rare-earth magnets of Examples 1, 2.

It is demonstrated from FIG. 17 that residual magnetization of Example 2 is largely improved as compared with Example 1 on a top face (a measuring point C1) at a central position of the rare-earth magnet, and there is no large difference in residual magnetization therebetween at the other measuring points at the central position.

Further, in Example 2, it is demonstrated that residual magnetization at a measuring point near the top face at the central position has a value closer to residual magnetization at the other measuring points.

Based on the foregoing, it is found that, by providing the projection portion on the top face of the sintered body as well as the recessed portion provided on the side face thereof, generally uniform residual magnetization is given to a whole area of a rare-earth magnet to be formed.

Thus, the embodiment of the present invention has been described with reference to the drawings, but concrete configurations of the present invention are not limited to the above embodiment. The embodiment of the present invention may be modified appropriately, and, further, various embodiments may be combined.

What is claimed is:

1. A manufacturing method of a rare-earth magnet, comprising:

manufacturing a sintered body by performing pressing on a magnetic powder for a rare-earth magnet;

putting the sintered body in a plastic working mold; and performing hot plastic working on the sintered body while pressing the sintered body to give anisotropy to the sintered body, wherein the sintered body has a cuboid shape and includes at least one recessed side face, each of the at least one recessed side face having a recessed portion curved inward, and the plastic working mold includes a lower die, a side die forming a rectangular frame of four side faces, and an upper die slidable in the side die, and the hot plastic working is hot upsetting, and the sintered body has a projection portion that is curved outward in an upward or downward direction of the sintered body, the projection portion having a central portion that is provided in a central region of at least one of a top face and a bottom face of the sintered body, and the central portion of the projection portion is curved outward in the upward or downward direction of the sintered body, and in the hot upsetting, a whole area of each of the at least one recessed side face simultaneously comes in contact with a corresponding side face of the side die after deformation of the sintered body.

2. The manufacturing method according to claim 1, wherein the at least one recessed side face includes a pair of recessed side faces along a longitudinal direction of the sintered body, and a central portion of the recessed portion of each of the at least one recessed side face is provided in a central region of each of the at least one recessed side face, respectively.

3. The manufacturing method according to claim 1, wherein the recessed portion of each of the at least one recessed side face is formed by performing pressing on the magnetic powder when the sintered body is manufactured.

4. The manufacturing method according to claim 1, wherein the recessed portion of each of the at least one recessed side face and the projection portion are formed by performing pressing on the magnetic powder when the sintered body is manufactured.

5. The manufacturing method according to claim 1, wherein when the hot plastic working is performed on the sintered body, the at least one recessed side face and a side face of the sintered body perpendicular to the at least one recessed side face come in contact with corresponding ones of the side faces of the side die simultaneously.

6. The manufacturing method according to claim 1, wherein when the hot plastic working is performed on the sintered body, four side faces of the sintered body come in contact with the side die simultaneously.

7. A manufacturing method of a rare-earth magnet, comprising:

manufacturing a sintered body by performing pressing on a magnetic powder for a rare-earth magnet, wherein the sintered body has a cuboid shape and includes at least one recessed side face, each of the at least one recessed side face having a recessed portion curved inward, and wherein a shape and a dimension of the recessed portion of each of the at least one recessed side face is based on parameters including a predetermined friction coefficient between a plastic working mold and the sintered body, a predetermined material physical property of the sintered body, a predetermined dimension of the sintered body, a predetermined processing rate in hot upsetting, and predetermined deformation amounts of given parts of the sintered body in the hot upsetting;

putting the sintered body in the plastic working mold, wherein the plastic working mold includes a lower die, a side die forming a rectangular frame of four side faces, and an upper die slidable in the side die; and performing the hot upsetting on the sintered body while pressing the sintered body to give anisotropy to the sintered body, such that a whole area of each of the at least one recessed side face simultaneously comes in contact with a corresponding side face of the plastic working mold after deformation of the sintered body.

8. The manufacturing method according to claim 7, wherein the sintered body has a projection portion that is curved outward in an upward or downward direction of the sintered body, the projection portion having a central portion that is provided in a central region of at least one of a top face and a bottom face of the sintered body, and the central portion of the projection portion is curved outward in the upward or downward direction of the sintered body, and a shape and dimension of the projection portion is based on the parameters.

* * * * *